US011408675B2

(12) United States Patent
Brett et al.

(10) Patent No.: US 11,408,675 B2
(45) Date of Patent: Aug. 9, 2022

(54) METHOD AND APPARATUS IN A CRYOGENIC LIQUEFACTION PROCESS

(71) Applicant: Highview Enterprises Limited, London (GB)

(72) Inventors: Stephen Gareth Brett, Reading (GB); Nicola Castellucci, Woking (GB)

(73) Assignee: Highview Enterprises Limited, London (GB)

( * ) Notice: Subject to any disclaimer, the term of this patent is extended or adjusted under 35 U.S.C. 154(b) by 611 days.

(21) Appl. No.: 14/780,101

(22) PCT Filed: Mar. 26, 2014

(86) PCT No.: PCT/GB2014/050959

§ 371 (c)(1),
(2) Date: Sep. 25, 2015

(87) PCT Pub. No.: WO2014/155108

PCT Pub. Date: Oct. 2, 2014

(65) Prior Publication Data

US 2016/0047597 A1 Feb. 18, 2016

(30) Foreign Application Priority Data

Mar. 27, 2013 (GB) ..... 1305640

(51) Int. Cl.
*F25J 1/02* (2006.01)
*F25J 1/00* (2006.01)

(52) U.S. Cl.
CPC ..... *F25J 1/02* (2013.01); *F25J 1/005* (2013.01); *F25J 1/0012* (2013.01); *F25J 1/0072* (2013.01); *F25J 1/0204* (2013.01); *F25J 1/0222* (2013.01); *F25J 1/0268* (2013.01); *F25J 2210/62* (2013.01); *F25J 2220/62* (2013.01)

(58) Field of Classification Search
CPC ..... F25J 1/0221; F25J 1/0222; F25J 1/0224; F25J 1/0227; F25J 1/0223; F25J 1/0072
See application file for complete search history.

(56) References Cited

U.S. PATENT DOCUMENTS 3,892,103 A * 7/1975 Antonelli ..... C02F 1/22 62/532
4,054,433 A * 10/1977 Buffiere ..... F17C 9/04 62/48.1
4,843,829 A 7/1989 Stuber et al.
4,846,862 A 7/1989 Cook
(Continued)

FOREIGN PATENT DOCUMENTS

EP 1092930 A1 4/2001
EP 1469265 A1 10/2004
(Continued)

OTHER PUBLICATIONS

Translation of JP ref.*
(Continued)

*Primary Examiner* — John F Pettitt, III
(74) *Attorney, Agent, or Firm* — Andrew J. Anderson, Esq.; Harter Secrest & Emery LLP

(57) ABSTRACT

Methods and apparatus for the efficient cooling within air liquefaction processes with integrated use of cold recovery from an adjacent LNG gasification process are disclosed.

16 Claims, 5 Drawing Sheets

(56) References Cited

U.S. PATENT DOCUMENTS

| | | | | |
|---|---|---|---|---|
| 6,041,620 | A | 3/2000 | Olszewski et al. | |
| 6,105,388 | A | 8/2000 | Acharya et al. | |
| 6,298,688 | B1 | 10/2001 | Brostow et al. | |
| 6,461,583 | B1 | 10/2002 | Hayashida et al. | |
| 2003/0089125 | A1* | 5/2003 | Fredheim | F25J 1/0022 62/612 |
| 2003/0226373 | A1* | 12/2003 | Prible | B63B 27/24 62/612 |
| 2010/0251763 | A1 | 10/2010 | Audun | |
| 2010/0319361 | A1* | 12/2010 | Chantant | F25J 1/0015 62/50.2 |

FOREIGN PATENT DOCUMENTS

| | | | | |
|---|---|---|---|---|
| GB | 1115336 | | | 5/1968 |
| JP | 54121347 | A | * | 9/1979 |
| JP | 58176113 | | | 10/1983 |
| JP | 58176113 | A | | 10/1983 |
| JP | 62191030 | A | | 8/1987 |
| JP | 63271084 | A | | 11/1988 |
| JP | 02106688 | A | | 4/1990 |
| JP | 02157583 | A | | 6/1990 |
| JP | 04127850 | A | | 4/1992 |
| JP | H04127850 | A | | 4/1992 |
| JP | 2001165561 | A | | 6/2001 |
| JP | 3208547 | B2 | * | 9/2001 ..... F25J 3/04812 |
| JP | 2009540259 | A | | 11/2009 |
| JP | 2009544923 | A | | 12/2009 |
| WO | 0027509 | A1 | | 5/2000 |
| WO | 2007096656 | A1 | | 8/2007 |
| WO | 2008009721 | A2 | | 1/2008 |

OTHER PUBLICATIONS

International Search Report of corresponding International Publication No. 2014/155108 dated Oct. 2, 2014.

Japanese Patent Office, Office Action from JP Patent Application No. JP2016-504749 dated Feb. 26, 2018 (14 pages including English language translation).

Japanese Patent Office, Office Action from JP Patent Application No. JP2016-504749 dated Sep. 3, 2018.

Mexican Patent Office, Summary of Office Action from MX Patent Application No. MX/A/2015/013569 dated Sep. 27, 2018.

* cited by examiner

PRIOR ART

METHOD AND APPARATUS IN A CRYOGENIC LIQUEFACTION PROCESS

FIELD OF THE INVENTION

The present invention relates to cryogenic energy storage systems, and particularly to the efficient utilisation of cold streams from an external source, such as from a liquefied natural gas (LNG) regasification process.

BACKGROUND OF THE INVENTION

Electricity transmission and distribution networks (or grids) must balance the generation of electricity with the demand from consumers. This is normally achieved by modulating the generation side (supply side) by turning power stations on and off, and running some at reduced load. As most existing thermal and nuclear power stations are most efficient when run continuously at full load, there is an efficiency penalty in balancing the supply side in this way. The expected introduction of significant intermittent renewable generation capacity, such as wind turbines and solar collectors, to the networks will further complicate the balancing of the grids, by creating uncertainty in the availability of parts of the generation fleet. A means of storing energy during periods of low demand for later use during periods of high demand, or during low output from intermittent generators, would be of major benefit in balancing the grid and providing security of supply.

Power storage devices have three phases of operation: charge, store and discharge. Power storage devices generate power (discharge) on a highly intermittent basis when there is a shortage of generating capacity on the transmission and distribution network. This can be signalled to the storage device operator by a high price for electricity in the local power market or by a request from the organisation responsible for the operating of the network for additional capacity. In some countries, such as the United Kingdom, the network operator enters into contracts for the supply of back-up reserves to the network with operators of power plants with rapid start capability. Such contracts can cover months or even years, but typically the time the power provider will be operating (generating power) is very short. In addition, a storage device can provide an additional service in providing additional loads at times of oversupply of power to the grid from intermittent renewable generators. Wind speeds are often high overnight when demand is low. The network operator must either arrange for additional demand on the network to utilise the excess supply, through low energy price signals or specific contracts with consumers, or constrain the supply of power from other stations or the wind farms. In some cases, especially in markets where wind generators are subsidised, the network operator will have to pay the wind farm operators to 'turn off' the wind farm. A storage device offers the network operator a useful additional load that can be used to balance the grid in times of excess supply.

For a storage device to be commercially viable the following factors are important: capital cost per MW (power capacity), MWh (energy capacity), round trip cycle efficiency and lifetime with respect to the number of charge and discharge cycles that can be expected from the initial investment. For widespread utility scale applications it is also important that the storage device is geographically unconstrained—it can be built anywhere, in particular next to a point of high demand or next to a source of intermittency or a bottleneck in the transmission and distribution network.

One such storage device technology is the storage of energy using cryogen such as liquid air or nitrogen (Cryogenic Energy Storage (CES)) which offers a number of advantages in the market place. Broadly speaking a CES system would, in the charge phase, utilise low cost or surplus electricity, at periods of low demand or excess supply from intermittent renewable generators, to liquefy a working fluid such as air or nitrogen. This is then stored as a cryogenic fluid in a storage tank, and subsequently released to drive a turbine, producing electricity during the discharge or power recovery phase, at periods of high demand or insufficient supply from intermittent renewable generators.

Cryogenic Energy Storage (CES) Systems have several advantages over other technologies in the market place, one of which is their founding on proven mature processes. Means to liquefy air, necessary in the charging phase, have existed for more than a century; early systems utilised a simple Linde cycle in which ambient air is compressed to a pressure above critical (≥38 bar), and progressively cooled to a low temperature before experiencing an isenthalpic expansion through an expansion device such as a Joule-Thomson valve to produce liquid. By pressurising the air above the critical threshold, the air develops unique characteristics and the potential for producing large amounts of liquid during expansion. The liquid is drained off and the remaining fraction of cold gaseous air is used to cool the incoming warm process stream. The amount of liquid produced is governed by the required amount of cold vapour and inevitably results in a low specific yield.

An evolution of this process is the Claude cycle (for which the current state of the art is shown in FIG. 4); the process is broadly the same as the Linde cycle however one or more streams 36, 39 are separated from the main process stream 31 where they are expanded adiabatically through turbines 3, 4, resulting in a lower temperature for a given expansion ratio than an isenthalpic process and hence efficient cooling. The air expanded through turbines 3, 4 then rejoins the returning stream 34 and aids the cooling of the high pressure stream 31 via heat exchanger 100. Similar to the Linde cycle the bulk of liquid is formed via expansion through an expansion device such as a Joule-Thomson valve 1. The main improvement with the Claude process is that power produced by the expansion turbines 3, 4 directly or indirectly reduces the overall power consumption, resulting in greater energy efficiency.

The most efficient modern air liquefaction processes typically use a two turbine Claude design, and at commercial scale can typically achieve an optimum specific work figure of around 0.4 kWh/kg. Although highly efficient this would not enable a CES system to achieve a market entry Round Trip Efficiency figure of 50%, without significant reductions in specific work.

In order to achieve greater efficiencies the liquefaction process within a fully integrated CES system, such as the one disclosed in WO2007-096656A1, utilises cold energy captured in the evaporation of the cryogen during the power recovery phase. However the source of cold energy can just as easily be taken from an external process, such as a process carried out adjacent to the CES system. In certain cases, it is particularly beneficial to utilise cold energy from an external process which is considered waste.

One such external process which may be utilised in a CES system is the LNG regasification process. A CES system could utilise the waste cold stream which is often continuously expelled from a LNG regasification terminal during liquid production. This is of particular advantage if the regasification terminal is adjacent the CES system. Such use of the cold stream potentially negates the requirement for cold energy to be stored in an integrated thermal store such as the one detailed in GB 1115336.8. Instead, that cold energy can immediately be used during the charging phase to provide additional cooling to the main process stream in the liquefaction process.

An exemplary system is shown in FIG. 5. Here, the main process stream (31, 35) is compressed to a high pressure, preferably at least the critical pressure (which for air is 38 bar) and more preferably 56 bar, at ambient temperature (≈298 k). The stream enters at inlet (31), where it is directed through passage (35) of heat exchanger (100), and is cooled progressively by both the cold low pressure return stream (41) and the cold recovery circuit HTF by virtue of its proximity to passage (52). The HTF in the cold recovery circuit may comprise of a gas or a liquid, at high or low pressure. However, a gas such as Nitrogen is preferred. The cold recovery circuit HTF can be replaced by direct flow of the cold source, such as LNG.

The cold recovery circuit typically consists of a means of circulation (5), such as a mechanical blower, and a first heat exchanger (101) in addition to the second heat exchanger (100). In the exemplary case, the HTF is circulated around the cold recovery circuit by mechanical blower (or similar means of circulation) and enters heat exchanger (101) at between 283-230 k. The HTF travels through the heat exchanger (101) and is progressively cooled, before exiting at between 108-120 k. The HTF is then directed to heat exchanger (100) via passage (52) where it provides cooling to the high pressure process gas stream by virtue of its proximity to passage (52).

A proportion of the high pressure main process stream (35), now at a temperature of between 150-170 k, is separated from the main process stream (35) and is expanded (to between 1 and 5 bar, for example) through an expansion turbine (4).

The separated portion exits the expansion turbine (4) and enters a phase separator (2), where the gaseous vapour fraction (typically ≈96%) is directed through heat exchanger (100). Cold thermal energy is transferred from the gaseous vapour fraction to the high pressure main process stream (35) in the heat exchanger (100) by virtue of the proximity of the main process stream (35) to passage (41). The remaining ≈4% is collected through stream (33) in the form of liquid.

The main process gas stream exits heat exchanger (100) at approximately 55-56 bar and 97 k where it is expanded through Joule-Thomson valve (1), or other means of expansion. This creates a typical composition of stream with liquid fraction of 96% which is directed to the phase separator (2). The liquid fraction is collected through stream (33) and vapour fraction expelled through passage (41).

Liquefied natural gas may be stored at −160 degC in large-volume low-pressure tank. Exemplary tanks are provided at LNG import terminals in Britain, including those known as Dragon and South Hook, in Milford Haven, UK. In these terminals, seawater is typically used as a heating fluid to regasify the LNG, and the resulting cold energy is simply dissipated as waste. However, if the cold energy is harnessed and recycled in the liquefaction process, the electrical consumption may be potentially reduced by as much as two thirds. This approach has been adopted in the design of nitrogen liquefiers, for instance, a number of which are in operation at LNG import terminals in Japan and Korea.

The necessary change in enthalpy that an arbitrary high pressure process stream must undergo to reach the required temperature to maximise liquid production when expanded through an expansion device such as a Joule-Thomson valve is shown in FIG. 1. A typical ideal cooling stream must similarly undergo an enthalpy change throughout the process as shown by the profile in FIG. 2, marked 'No Cold Recycle'. The second profile in FIG. 2 demonstrates the dramatic change in required cooling (i.e. relative change of enthalpy) when large quantities of cold recycle are introduced into the system, marked 'Cold Recycle'. FIG. 2 shows quantities of cold recycle in the region of 250 kJ/kg (defined as cooling enthalpy per kg of liquid product delivered), which is consistent with levels of cold recycle used in a fully integrated cryogenic energy system such as the one disclosed in WO2007-096656A1. As is evident from FIG. 2, the addition of the cold recycle completely satisfies the cooling requirements in the higher temperature end of the process. The use of an external waste cold stream such as that available in the LNG regasification process in place of the 'Cold Recycle' stream presents a similar curve of resultant cooling. Despite the abundant quantity of cold energy available (compared with the 'Cold Recycle' system disclosed in WO2007-096656A1, for example) the cold is of insufficient quality to provide cooling at the lower end of the process.

This presents a problem with current state of the art liquefaction processes which are designed to be used with more progressive thermal energy profiles, and are much more effectively handled by a single cooling stream running the extent of the heat exchanger. As can be seen from FIG. 3 the effective cooling stream produced by current state of the art processes (indicated by profile marked 'state of the art'), such as the Claude cycle shown in FIG. 4, is extremely linear in comparison to the required profile in a system using large quantities of cold recycle (indicated by profile marked 'Ideal Profile'), and a very poor match. To meet the acute cooling demand at the lower temperature end, a typical state of the art process must expand a similar quantity of air through the cold turbine as a system without cold recycle. This results in poor efficiencies and heat transfer requirements above the maximum design level of the device within the process heat exchangers.

The present inventors have identified that there is a need for a system that can provide focused non-progressive cooling to concentrated areas of the process, in particular at the lower temperature end of the process.

SUMMARY OF THE INVENTION

The present invention provides a cryogenic liquefaction device comprising:

a first heat exchanger;

a phase separator;

an expansion device;

a first arrangement of conduits, arranged such that a pressurised stream of gas is directed through the first heat exchanger, the expansion device and the phase separator;

a cold recovery circuit including first a heat transfer fluid and a second arrangement of conduits arranged such that the first heat transfer fluid is directed through the first heat exchanger in a counter-flow direction to the pressurised stream of gas; and an refrigerant circuit including a second heat transfer fluid and a third arrangement of conduits arranged such that the second heat transfer fluid is directed through the first heat exchanger in a counter-flow direction to the pressurised stream of gas; wherein:

each of the second and third arrangements of conduits forms a closed pressurised circuit.

In the context of the present invention, the phrase "a counter-flow direction" is used to mean that the first and/or second heat transfer fluids (HTFs) flow through the first heat exchanger in an opposite direction to the pressurised stream of gas, for at least a part of its path through the heat exchanger. The first and/or second heat transfer fluids and the pressurised stream of gas may enter the heat exchanger at opposite ends, i.e. so that the temperature difference between the entry points of the respective fluids is maximised. Alternatively, the first and/or second heat transfer fluids and the pressurised stream of gas may enter the heat exchanger at a point between the ends of the heat exchanger, but flow through the heat exchanger in an opposite direction to the other of the first and/or second heat transfer fluids and the pressurised stream of gas may, for at least a part of its path through the heat exchanger.

The heat transfer fluid within the cold recovery circuit and/or the refrigerant circuit may comprise a gas or a liquid, at high or low pressure.

The pressurised stream of gas (i.e. the process stream) may consist of gaseous air at a pressure above the critical pressure (for instance, ≥38 bar).

The present invention offers increased efficiency as a result of the pressurised stream of gas (i.e. the process stream) being fully cooled by the use of separate cold recovery and refrigerant circuits. In particular, the use of the separate cold recovery circuit and refrigerant circuit enables the larger quantities of cold energy to be utilised in the cooling of the pressurised stream of gas, compared with a cold recovery circuit on its own.

Moreover, the efficiency of the present invention is further enhanced compared with prior art devices because the flow rate of the pressurised stream of gas (i.e. the process stream) may be reduced as a result of not need to recycle the process stream for cooling.

Preferably, the cold recovery circuit further comprises a second heat exchanger and a fourth arrangement of conduits arranged such that a first cold stream of gas is directed through the second heat exchanger. In such cases, the second arrangement of conduits is arranged such that the first heat transfer fluid is directed through the second heat exchanger in a counter-flow direction to the first cold stream of gas.

More preferably, the refrigerant circuit further comprises a third heat exchanger and a fifth arrangement of conduits arranged such that a second cold stream of gas is directed through the third heat exchanger. In such cases, the third arrangement of conduits is arranged such that the second heat transfer fluid is directed through the third heat exchanger in a counter-flow direction to the second cold stream of gas.

As explained above, in the context of the present invention, the phrase "a counter-flow direction" is used to mean that the first and/or second cold streams of gas flow through the second and/or third heat exchangers, respectively, in an opposite direction to the first and/or second heat transfer fluids, respectively, for at least a part of their paths through the second and/or third heat exchangers, respectively.

The first and second cold streams of gas may be one and the same cold stream of gas. That is, the fourth and fifth arrangements of conduits may be one and the same arrangement of conduits (i.e. connected). Moreover, the second and third heat exchangers may be one and the same heat exchanger.

Preferably, the first and/or second cold streams of gas is are waste streams, and is even more preferably a waste stream from a liquefied natural gas (LNG) regasification process.

Thus, in a particularly preferred embodiment, a waste stream from a liquefied natural gas (LNG) regasification process may be passed through a heat exchanger through which both the second and third arrangements of conduits (i.e. of the cold recovery and refrigerant circuits, respectively) also pass.

In some embodiments, the cold recovery circuit further comprises means for circulating the first heat transfer fluid through the second arrangement of conduits. For example, the second arrangement of conduits may be arranged such that the first heat transfer fluid is directed through the means for circulating the heat transfer fluid before being directed through the first heat exchanger. The means for circulating the first heat transfer fluid may be a mechanical blower.

In some embodiments, the refrigerant circuit further comprises a compression device. In such embodiments, the third arrangement of conduits is arranged such that the second heat transfer fluid is directed through the compression device before being directed through the third heat exchanger.

In some embodiments, the refrigerant circuit further comprises an expansion turbine. In such embodiments, the third arrangement of conduits is arranged such that the second heat transfer fluid is directed through the expansion turbine before being directed through the first heat exchanger.

The expansion device may be a Joule-Thomson valve.

Preferably, the second arrangement of conduits is arranged adjacent to the first arrangement conduits in a first region of the first heat exchanger, and more preferably, the third arrangement of conduits is arranged adjacent to the first arrangement conduits in a second region of the first heat exchanger. In such a case, the second region may be closer to the expansion device, in a flow direction, than the first region. In such cases, the pressurised stream of gas may be directed through the first heat exchanger such that it flows in the vicinity of the cold recovery circuit before it flows in the vicinity of the refrigerant circuit.

The present invention also provides a method for balancing a liquefaction process with the use of cold recycle from an external thermal energy source comprising:

directing a pressurised stream of gas through a first heat exchanger, an expansion device and a phase separator;

directing a first heat transfer fluid in a cold recovery circuit through the first heat exchanger in a counter-flow direction to the pressurised stream of gas; and directing a second heat transfer fluid in an refrigerant circuit through the first heat exchanger in a counter-flow direction to the pressurised stream of gas; wherein:

each of the second and third arrangements of conduits forms a closed pressurised circuit.

The method may further comprise directing a first cold stream of gas through a second heat exchanger; and directing the first heat transfer fluid through the second heat exchanger in a counter-flow direction to the first cold stream of gas.

The method may further comprise directing a second cold stream of gas through a third heat exchanger; and directing the second heat transfer fluid through the third heat exchanger in a counter-flow direction to the second cold stream of gas.

Again, the first and second cold streams of gas may be one and the same cold stream of gas and the second and third heat exchangers may be one and the same heat exchanger.

In such cases, the first and/or second cold streams of gas may be a waste stream, such as a waste stream from a liquefied natural gas (LNG) regasification process for example.

Preferably the method comprises directing the second heat transfer fluid through a means for circulating the heat transfer fluid before directing it through the first heat exchanger.

Preferably the method comprises directing the second heat transfer fluid through a compression device before directing it through the third heat exchanger.

Preferably the method comprises directing the second heat transfer fluid through an expansion turbine before directing it through the first heat exchanger.

Preferably, the step of directing the pressurised stream of gas through the first heat exchanger comprises directing it past the cold recovery circuit before directing it past the refrigerant circuit.

BRIEF DESCRIPTION OF THE DRAWINGS

Embodiments of the present invention will now be described with reference to the figures in which.

DETAILED DESCRIPTION OF THE INVENTION

Figure 1:
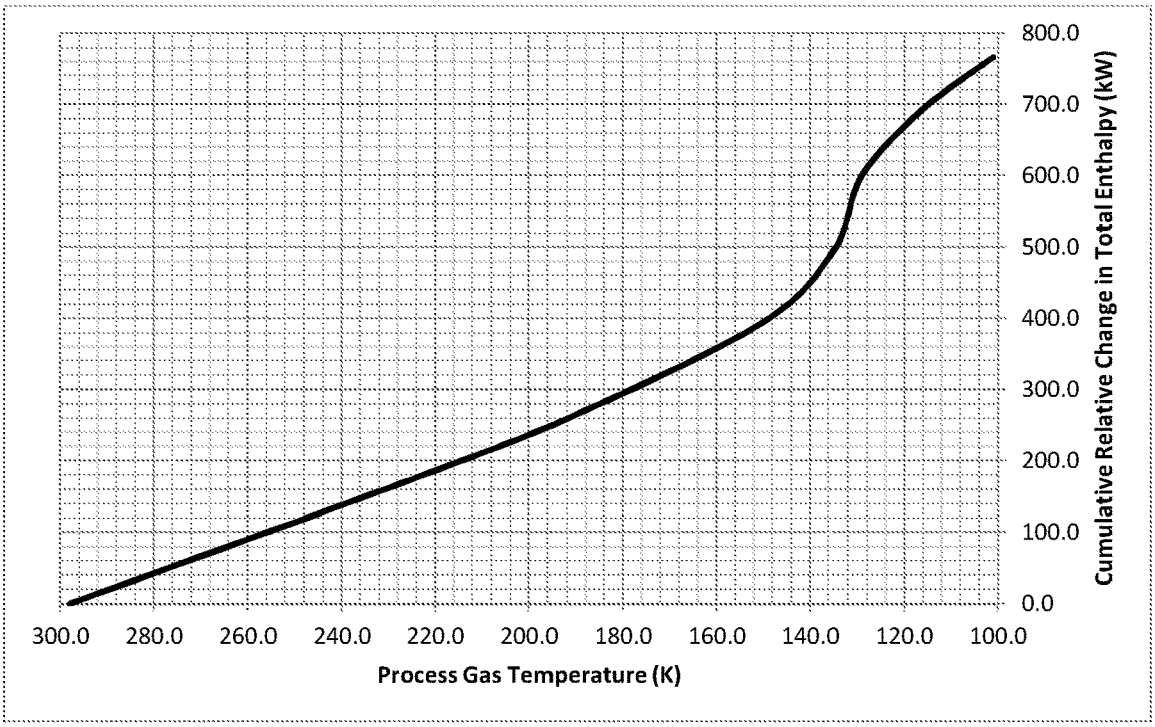
FIG. 1 shows a profile of the relative change in total enthalpy in which the process gas undergoes during the cooling process (Relative Change of Total Enthalpy vs Process Gas Temperature)
Figure 2:
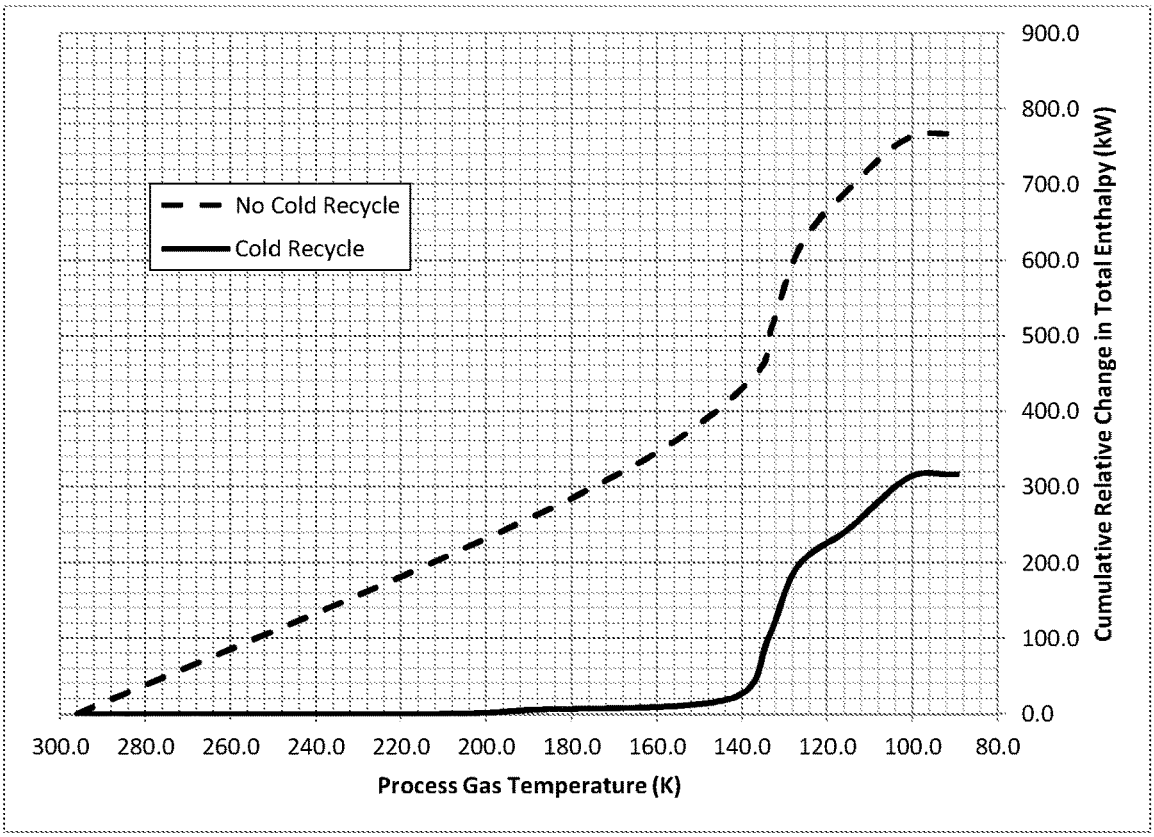
FIG. 2 shows profiles of the relative change in total enthalpy in which the cooling streams must undergo during the cooling process for systems with and without the use of large quantities of cold recycle (Relative Change of Total Enthalpy vs Process Gas Temperature)
Figure 3:
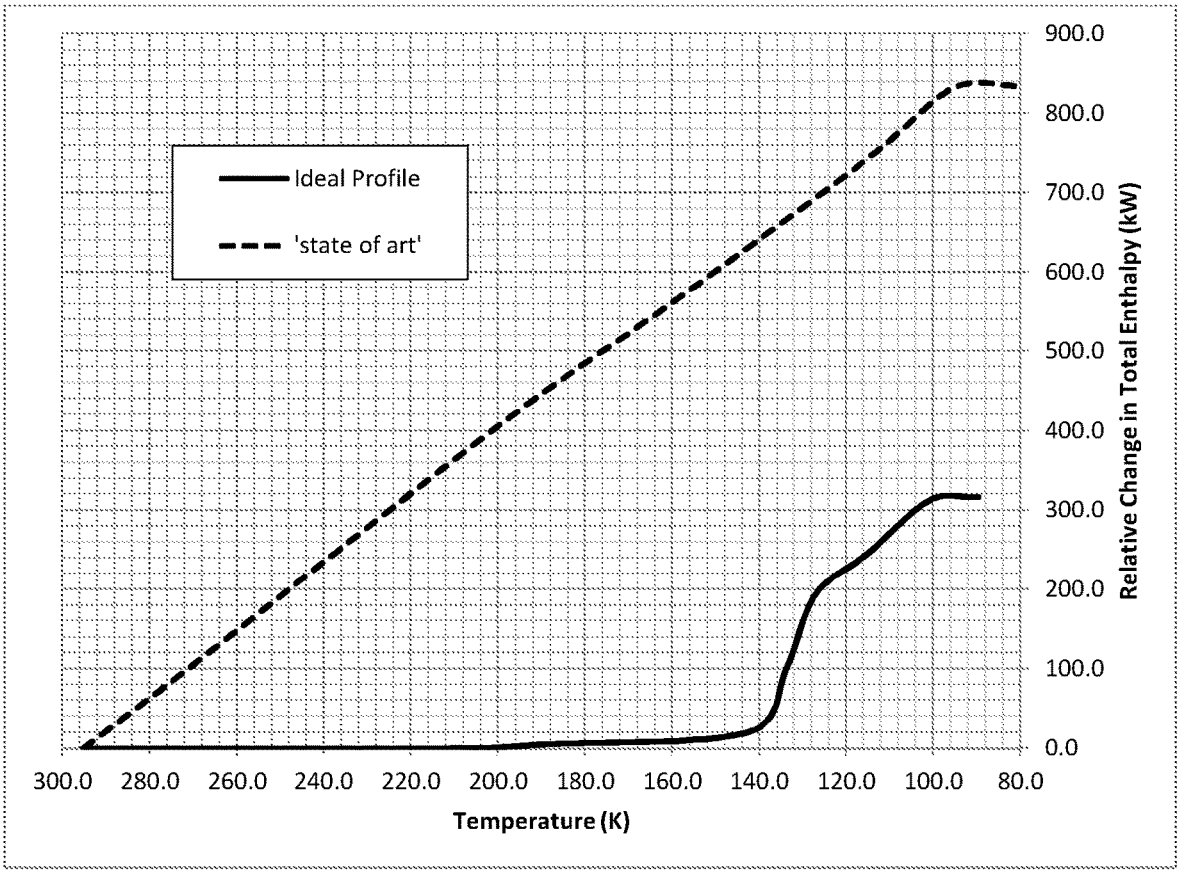
FIG. 3 shows profiles of the relative change in total enthalpy in which the cooling streams must undergo during the cooling process for 'ideal' and 'state of art' systems with the use of large quantities of cold recycle (Relative Change of Total Enthalpy vs Process Gas Temperature)
Figure 4:
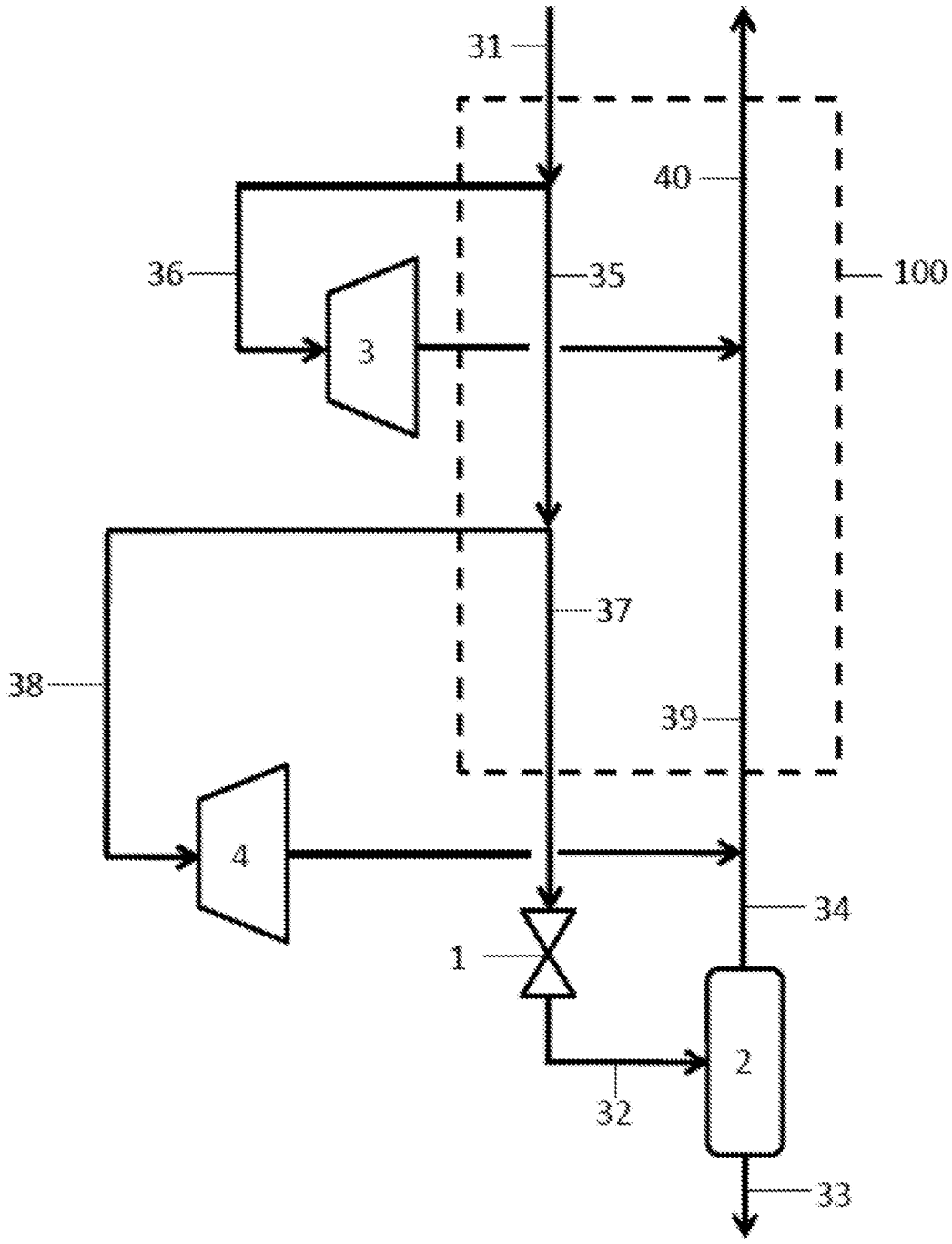
FIG. 4 shows a typical state of the art air liquefaction plant arrangement
Figure 5:
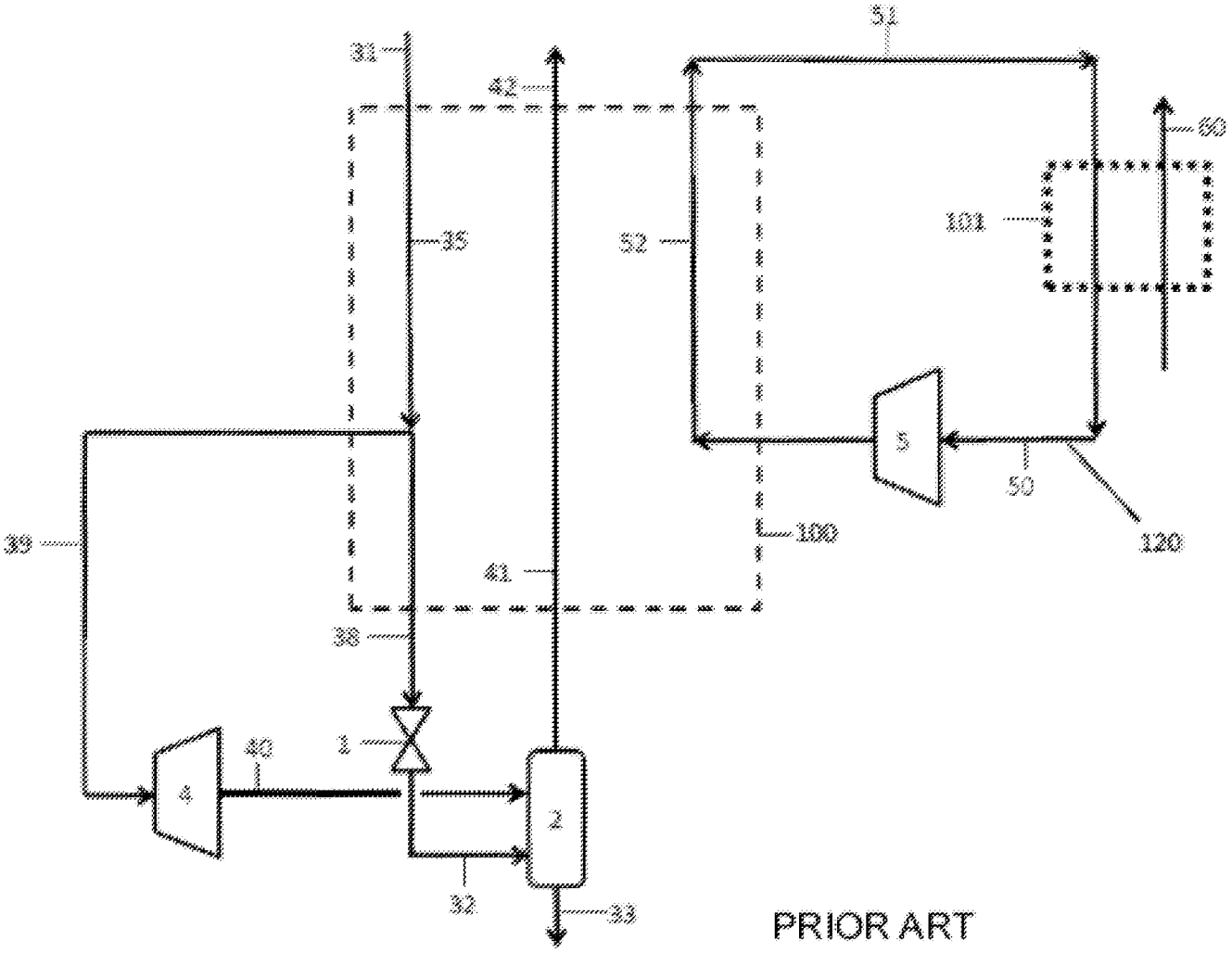
PRIOR ART Figure 5
FIG. 5 shows a schematic of a cryogenic energy system liquefaction process with 'cold recovery circuit' using typical state of the art air liquefaction plant arrangement.
Figure 6:
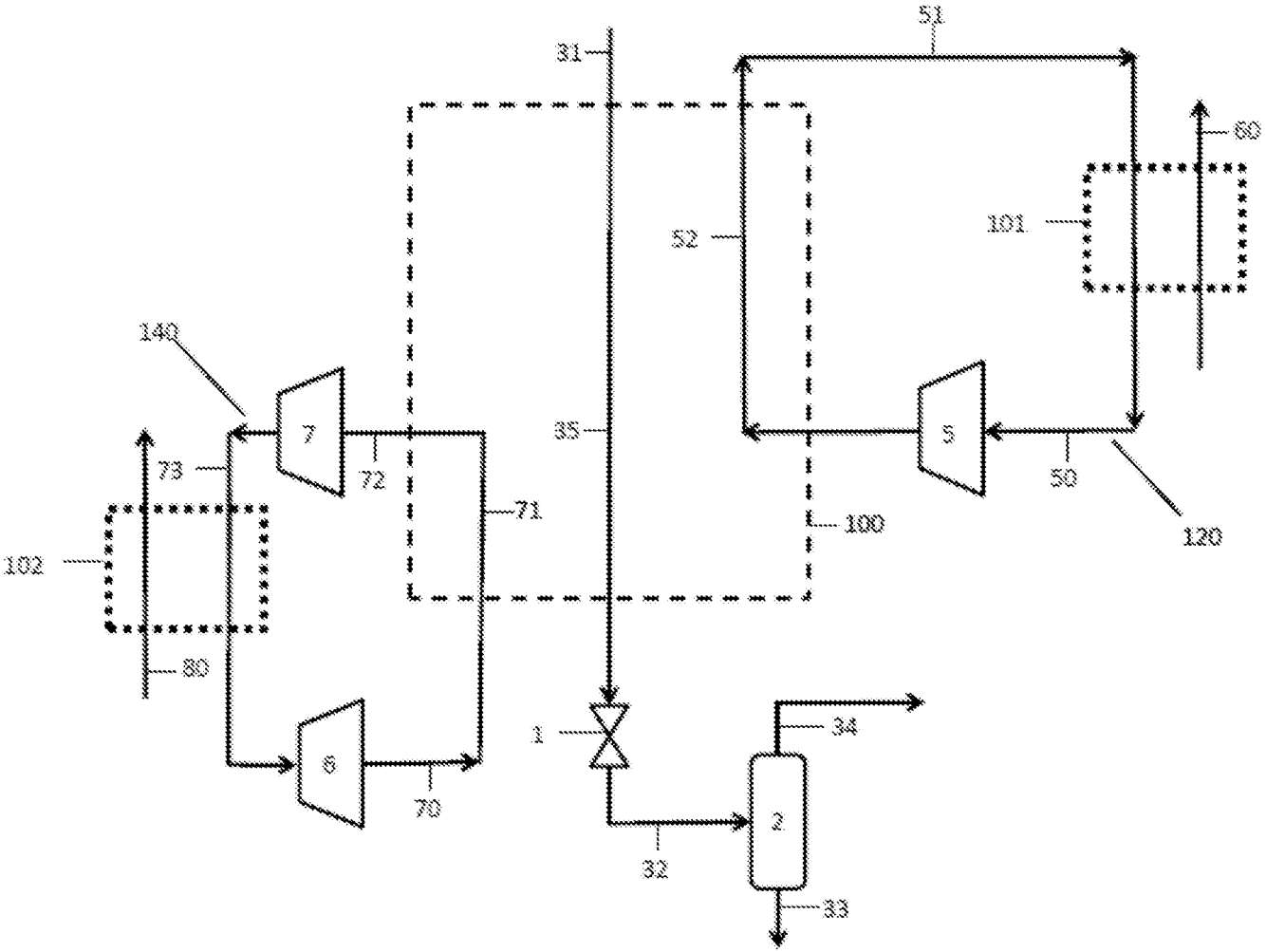
FIG. 6 shows a schematic of a cryogenic energy system liquefaction process according to a first embodiment of the present invention.

The first simplified embodiment of the present invention is shown in FIG. 6. The system in FIG. 6 is similar to that of the conventional layout shown in FIG. 5 in that a pressurised stream of gas (the main process gas stream (31, 35)) is cooled to a temperature using the cold energy recovered from a stream of LNG (60), after which additional cooling is provided before the stream (31, 35) is expanded through a Joule-Thomson Valve (1) to produce liquid air.

However, whereas the additional cooling in the layout shown in FIG. 5 is provided by the a portion of the main process gas stream (31, 35) itself, the additional cooling in the embodiment of FIG. 6 according to the present invention is provided by cold energy recovered from a stream of LNG (80) in a refrigerant circuit (140). The stream of LNG (80) used in the refrigerant circuit (140) may be the same stream as the stream of LNG (60) used in the cold recovery circuit (120) or it may be a different stream. Likewise, the heat exchanger (102) used in the refrigerant circuit (140) may be the same heat exchanger (101) used in the cold recovery circuit (120) or it may be a different heat exchanger.

In the first embodiment, the main process gas stream (31, 35) is compressed to high pressure, preferably of at least the critical pressure (which for air is 38 bar), but more preferably 56 bar, at ambient temperature (≈298 k). The main process gas stream (31, 35) enters inlet 31, from which point it is directed through a first heat exchanger (100) and is cooled progressively by the cold recovery circuit (120) HTF passing through passage (52). The HTF in the cold recovery circuit (120) may comprise gas or a liquid, at high or low pressure. In the preferred case, a gas such as Nitrogen at a pressure of 5 bar is used.

The cold recovery circuit (120) consists of a means of circulation (5) such as a mechanical blower. A second heat exchanger 101 is provided in addition to the first heat exchanger 100 described above. The HTF is circulated around the cold recovery circuit by the mechanical blower and enters the second heat exchanger 101 at 185 k. The HTF is progressively cooled by virtue of its proximity to the waste stream of LNG (60) passing through the first heat exchanger, and exits the second heat exchanger at around 123 k. The HTF is then directed to the first heat exchanger 100, through which it passes via passage 52 providing cooling to the high pressure main process gas stream (31, 35) by virtue of its proximity thereto.

At point 35 the main process gas stream (31, 35) has been cooled to a temperature of between 110-135 k, but in the preferred case 124 k, and continues to pass through the first heat exchanger (100) in which it continues to be cooled progressively by a refrigerant circuit (140) HTF passing through passage (71) as described in more detail below.

The use of a refrigerant circuit (140) in the present invention enables the greater utilisation of lower quality cold energy to provide high quality cold energy which has hitherto been carried out by expanding a proportion of the high pressure main process gas stream, such as in the conventional system shown in FIG. 5.

In addition to the first heat exchanger (100), the refrigerant circuit (140) consists of a compressor (7), a third heat exchanger (102), and an expander (6). The refrigerant circuit (14) contains a HTF which may comprise of a gas or a liquid, at high or low pressure. However, in the preferred case, a gas such as Nitrogen at a pressure of between 1.4 and 7 bar is utilised. At point 72, the HTF is at a temperature of 122 k and a pressure of 1.4 bar. The HTF is compressed to higher pressure (for example between 5 bar and 10 bar, but preferably 7 bar) by compressor (7). The HTF exits the compressor (7) at temperature 206 k, before entering the third heat exchanger 102 where it is progressively chilled by virtue of its proximity to waste stream of LNG (80) passing through the third heat exchanger. The HTF then enters expander (6) at pressure 6.9 bar and temperature 123 k, where it is expanded to 1.5 bar and 84 k. The HTF then enters the first heat exchanger (100), where it is directed through passage 71 providing cooling to the high pressure main process gas stream (31, 35) by virtue of its proximity thereto.

Using Nitrogen as the HTF in both the cold recovery and refrigerant circuits of the present invention provides a level of isolation between the potentially hazard cold source and process gas which in the preferred case is LNG and gaseous air containing oxygen.

Finally the main process gas stream (31, 35) exits the first heat exchanger (100) at approximately 55-56 bar and 97 k, where it is expanded through a Joule-Thompson valve 1 (or other means of expansion device) creating a typical composition of an output stream with liquid fraction >95% (optimally >98%), which is directed in to the phase separator 2. The liquid fraction is collected through stream 33 and vapour fraction expelled through 34.

It will of course be understood that the present invention has been described by way of example, and that modifications of detail can be made within the scope of the invention as defined by the following claims.

The invention claimed is:

1. A cryogenic liquefaction device comprising:

a primary heat exchanger having a length;

a phase separator;

an expansion device;

a first arrangement of conduits, arranged such that a pressurised main stream of gas from a first source is directed through the length of the primary heat exchanger, the expansion device and the phase separator, whereby a portion of the main stream of gas is converted into cryogen;

a cold recovery circuit including a first heat transfer fluid and a second arrangement of conduits arranged such that the first heat transfer fluid is directed along the second arrangement of conduits adjacent to the first arrangement of conduits through a first portion of the length of the primary heat exchanger in a counter-flow direction to a flow direction of the pressurised main stream of gas through the primary heat exchanger for cooling the pressurised main stream of gas; and a refrigerant circuit including a second heat transfer fluid and a third arrangement of conduits arranged such that the second heat transfer fluid is directed along the third arrangement of conduits adjacent to the first arrangement of conduits through a second portion of the length of the primary heat exchanger in a counter-flow direction to the flow direction of the pressurised main stream of gas through the primary heat exchanger for further cooling the pressurised main stream of gas;

each of the second and third arrangements of conduits forming a pressurised closed-loop circuit;

the first and second portions of the length of the primary heat exchanger being arranged in succession so that the pressurised main stream of gas through the primary heat exchanger is cooled by the cold recovery circuit before the further cooling by the refrigerant circuit, at least one secondary heat exchanger and at least one secondary arrangement of conduits arranged such that a cold stream from a liquefied natural gas regasification terminal is directed through the at least one secondary heat exchanger; and the second and third arrangement of conduits being arranged such that the first and second heat transfer fluids are directed through the at least one secondary heat exchanger in a counter-flow direction to a flow direction of the cold stream through the at least one secondary heat exchanger for cooling the first and second heat transfer fluids, wherein the second arrangement of conduits of the closed-loop cold recovery circuit conveys the first heat transfer fluid to the primary heat exchanger after the first heat transfer fluid has been reduced in temperature by passing through the at least one secondary heat exchanger, wherein the closed-loop refrigerant circuit further comprises an expander, and wherein the third arrangement of conduits of the closed-loop refrigerant circuit conveys the second heat transfer fluid to the primary heat exchanger after the second heat transfer fluid has been reduced in temperature by passing through the at least one secondary heat exchanger and then further reduced in temperature by passing through the expander so that the temperature of the second heat transfer fluid that is directed to the primary heat exchanger is less than the temperature of the first heat transfer fluid that is directed to the primary heat exchanger.

2. The cryogenic liquefaction device of claim 1, configured such that an output stream from the expansion device has a liquid fraction of at least 95% of the pressurised main stream of gas from the first source.

3. The cryogenic liquefaction device of claim 2, configured such that the pressurised main stream of gas exits the primary heat exchanger at a pressure of between 55 and 56 bar and a temperature of 97 k.

4. The cryogenic liquefaction device of claim 1, wherein the cold stream is a liquefied natural gas.

5. The cryogenic liquefaction device of claim 2, wherein the cold stream is a liquefied natural gas.

6. The cryogenic liquefaction device of claim 1, wherein the cold recovery circuit further comprises means for circulating the first heat transfer fluid through the second arrangement of conduits.

7. The cryogenic liquefaction device of claim 6, wherein the second arrangement of conduits is arranged such that the first heat transfer fluid is directed from the at least one secondary heat exchanger and through the means for circulating the heat transfer fluid before being directed through the primary heat exchanger.

8. The cryogenic liquefaction device of claim 7, wherein the means for circulating the first heat transfer fluid is a mechanical blower.

9. The cryogenic liquefaction device of claim 1, wherein the refrigerant circuit further comprises a compression device, and wherein the third arrangement of conduits is arranged such that the second heat transfer fluid is directed from the primary heat exchanger and through the compression device before being directed through the at least one secondary heat exchanger.

10. The cryogenic liquefaction device of claim 1, wherein the expansion device is a joule-Thomson valve.

11. The cryogenic liquefaction device of claim 10, wherein the second portion of the length of the primary heat exchanger is closer to the expansion device, in the flow direction of the pressurised main stream of gas, than the first portion of the length of the primary heat exchanger.

12. A method for balancing a cryogenic liquefaction process comprising:

directing a pressurised main stream of gas from a first source through successive first and second portions of a length of a primary heat exchanger, an expansion device and a phase separator along a first arrangement of conduits, thereby converting a portion of the main stream of gas into cryogen;

directing a first heat transfer fluid in a pressurised closed-loop cold recovery circuit along a second arrangement of conduits adjacent to the first arrangement of conduits through the first portion of the length of the primary heat exchanger in a counter-flow direction to a flow direction of the pressurised main stream of gas for cooling the pressurised main stream of gas; and directing a second heat transfer fluid in a pressurised closed-loop refrigerant circuit along a third arrangement of conduits adjacent to the first arrangement of conduits through the second portion of the length of the primary heat exchanger in a counter-flow direction to the flow direction of the pressurised main stream of gas such that the pressurised main stream of gas through the primary heat exchanger is cooled by the cold recovery circuit before being cooled by the refrigerant circuit for further cooling the pressurised main stream of gas, wherein the step of directing the first and second heat transfer fluids includes directing the first and second heat transfer fluids through at least one secondary heat exchanger, and further comprising a step of directing a cold stream from a liquefied natural gas regasification terminal through the at least one secondary heat exchanger in a counter-flow direction to flow directions of the first and second heat transfer fluids through the at least one secondary heat exchanger for cooling the first and second heat transfer fluids, wherein the second arrangement of conduits of the closed-loop cold recovery circuit conveys the first heat transfer fluid to the primary heat exchanger after the first heat transfer fluid has been reduced in temperature by passing through the at least one secondary heat exchanger, wherein the closed-loop refrigerant circuit further comprises an expander, and wherein the third arrangement of conduits of the closed-loop refrigerant circuit conveys the second heat transfer fluid to the primary heat exchanger after the second heat transfer fluid has been reduced in temperature by passing through the at least one secondary heat exchanger and then further reduced in temperature by passing through the expander so that the temperature of the second heat transfer fluid that is directed to the primary heat exchanger is less than the temperature of the first heat transfer fluid that is directed to the primary heat exchanger.

13. The method of claim 12, wherein the cold stream is a liquefied natural gas.

14. The method of claim 12, further comprising:

directing the first heat transfer fluid from the at least one secondary heat exchanger and through a means for circulating the heat transfer fluid before directing the first heat transfer fluid through the primary heat exchanger.

15. The method of claim 12, further comprising:

directing the second heat transfer fluid from the primary heat exchanger and through a compression device before directing the second heat transfer fluid through the at least one secondary heat exchanger.

16. The method of claim 12, wherein an output stream from the expansion device has a liquid fraction of at least 95% of the pressurised main stream of gas from the first source.

* * * * *